US009506375B2

(12) United States Patent
Cachia

(10) Patent No.: US 9,506,375 B2
(45) Date of Patent: Nov. 29, 2016

(54) FAN GUARD

(71) Applicant: Control Techniques Limited, Newtown (GB)

(72) Inventor: Charles Anthony Cachia, Welshpool (GB)

(73) Assignee: CONTROL TECNIQUES LIMITED, Newtown (GB)

( * ) Notice: Subject to any disclaimer, the term of this patent is extended or adjusted under 35 U.S.C. 154(b) by 672 days.

(21) Appl. No.: 13/873,457

(22) Filed: Apr. 30, 2013

(65) Prior Publication Data

US 2013/0309067 A1 Nov. 21, 2013

(30) Foreign Application Priority Data

Apr. 30, 2012 (GB) ..... 1207674.1

(51) Int. Cl.
*F01D 25/24* (2006.01)
*F04D 29/70* (2006.01)

(52) U.S. Cl.
CPC ..... *F01D 25/243* (2013.01); *F04D 29/703* (2013.01)

(58) Field of Classification Search
CPC ..... F01D 24/243; F04D 29/703
USPC ..... 416/247 R
See application file for complete search history.

(56) References Cited

U.S. PATENT DOCUMENTS 5,788,566 A * 8/1998 McAnally ..... H05K 7/20172 361/695
6,435,889 B1 8/2002 Vinson et al.
6,468,054 B1 10/2002 Anthony et al.
6,699,301 B1 * 3/2004 Eisenhauer ..... B01D 46/0034 55/471
7,068,505 B2 6/2006 Kosugi
2002/0086574 A1 * 7/2002 Vinson ..... H05K 7/20172 439/247
2004/0154128 A1 * 8/2004 Ho ..... A47H 13/04 16/87.2
2004/0247431 A1 * 12/2004 Chen ..... F04D 29/601 415/182.1
2007/0231157 A1 * 10/2007 Chuang ..... F04D 19/007 416/247 R
2008/0075581 A1 * 3/2008 Chen ..... F04D 29/703 415/121.1
2011/0132268 A1 * 6/2011 Weber ..... A01K 7/025 119/72

FOREIGN PATENT DOCUMENTS

JP 2002-70798 3/2002

* cited by examiner

*Primary Examiner* — Ninh H Nguyen
*Assistant Examiner* — Aaron R Eastman
(74) *Attorney, Agent, or Firm* — Harness, Dickey & Pierce, P.L.C.

(57) ABSTRACT

There is provided a fan guard for mounting on an electrically-operated axial-flow fan. The fan guard comprises a plurality of fasteners for extending into a plurality of respective holes on the fan and further comprises a projection projecting outwardly from the fan guard from a central support which, in use, is coincident with a central region of the air flow from the axial-flow fan. The fasteners secure the fan guard on the fan by a friction fit between the fasteners and the holes, thereby rendering installation of the fan guard on a fan, and removal of the fan guard from the fan quick and straightforward.

13 Claims, 5 Drawing Sheets

FAN GUARD

CROSS-REFERENCE TO RELATED APPLICATION

This application claims the benefit and priority of Great Britain Application No. GB 1207674.1, filed Apr. 30, 2012. The entire disclosure of the above application is incorporated herein by reference.

FIELD OF THE INVENTION

The present invention relates to a fan guard for mounting on an electrically-operated axial-flow fan. The present invention further relates to electrical apparatus comprising such a fan guard.

BACKGROUND OF THE INVENTION

In any electrical power system in which heat is generated, vital components of the system often require cooling. Other types of machinery may also require cooling. A fan is often provided to draw a flow of air into the system, direct it onto the components, and prevent them from overheating. Generally, for cooling electrical equipment, an axial-flow fan is used, which directs a cooling flow of air generally parallel to the fan's axis. However, any suitable fan may be used.

If the motor and fan are mounted within a housing, it is usually inadvisable to allow access to the fan from outside the housing. Instead a fan guard may be provided, which allows air to be drawn into the housing, but does not allow large objects or fingers to be inserted into the housing and onto the fan. The fan guard must prevent access to the fan by large objects and fingers, but also allow the fan to operate normally.

It is an object of the invention to provide a fan guard which is an improvement over prior art arrangements.

SUMMARY OF THE INVENTION

According to a first aspect of the invention, there is provided a fan guard for mounting on an electrically-operated axial-flow fan, the fan guard comprising: a plurality of fasteners for extending into a plurality of respective holes on the fan, the fasteners being arranged to secure the fan guard on the fan by a friction fit between the fasteners and the holes; and a projection projecting outwardly from the fan guard from a central support which, in use, is coincident with a central region of the air flow from the axial-flow fan.

The fasteners allow the fan guard to be easily mounted on and removed from the fan. The friction fit fastening does not require tools or any additional components, and permits easy installation and removal of the fan guard. The fan guard may be arranged for use in an electrical device in which the fan is arranged to cool electrical components. The projection enables the guard to be removed easily for cleaning, maintenance, etc. By locating the projection at or near the centre of the fan's outlet, it occupies an area where there is less flow and, therfore, is less likely to restrict the fan output. Being in the centre also means that the guard can be pulled off more easily.

The fasteners allow the fan guard to be easily mounted on and removed from the fan, but the term "fan" in this context should be interpreted broadly. For example, the fan guard need not be mounted directly on the component which includes the fan's moving parts. The fan guard may be mounted on another fan component, for example, a fan filter or a fan frame. As long as the fasteners on the fan guard extend into holes on a portion of the electrically-operated axial-flow fan, so as to secure the fan guard by a friction fit, the fan guard should be understood to be mounted on the fan.

In one embodiment, the fan guard comprises an outer frame, an inner support and a plurality of ribs extending between the outer frame and the inner support. Such a structure provides adequate structural support for the fan guard, whilst also allowing airflow through the fan guard. The ribs prevent access to the fan, when the fan guard is mounted on the fan, by fingers and large objects.

In one embodiment, the ribs extend in a spiral between the inner support and the outer frame. The spiral shape may assist airflow and also creates an aesthetically pleasing appearance. In addition the ribs may be rounded on an outer side of the fan guard, which assists airflow and minimises noise. The outer side of the fan guard is that side which is outermost when the fan guard is mounted on the fan. Further ribs may be provided for additional structural support. The additional ribs may or may not extend between the inner support and the outer frame.

Preferably, the outer frame has the same cross sectional shape and size as the fan on which the fan guard is to be mounted. Preferably, the fasteners are provided on the outer frame.

Preferably, the fan guard comprises injection-moulded plastic. Injection-moulded plastic provides a strong structure and allows simple manufacture. Moreover, the particular three-dimensional shape of the fan guard may be easily adjusted for use with various types of fan. Any plastic suitable for injection moulding may be used.

In one embodiment, each fastener comprises a plurality of body portions for extending into the respective hole on the fan, the body portions arranged to be compressed towards each other when the fastener is inserted into the hole, so as to provide the friction fit.

In a preferred embodiment, two body portions are provided. However, any number, for example three, four, five or six body portions may be provided. The body portions are shaped and sized so as to provide a friction fit with the hole when the body portions are compressed towards each other. Alternatively, a single body portion may be provided. In that case, the single body portion should be shaped and sized so as to provide a friction fit with the hole when the body portion is inserted into the hole. The size and shape of the fasteners and the holes may be adjusted to adjust the strength of the friction fit (also known as interference fit).

Any suitable number of fasteners may be provided. For example, two, three, four, five, six or more fasteners may be provided. The particular number of fasteners may depend on the shape of the fan guard. For example, four fasteners may be provided on a square or rectangular fan guard—one at each corner. The fasteners may be positioned at any suitable position on the fan guard. Providing the fasteners on an outer edge of the fan guard may be advantageous for securely mounting the fan guard onto the fan. Preferably, the fasteners are incorporated into the fan guard design. If the fan guard comprises injection-moulded plastic, preferably the fasteners are moulded integrally with the body of the fan guard.

As the projection projects outwardly from the fan guard, the projection enables grasping by a user at a central location so that the pulling force applied to the projection is evenly distributed to the fasteners. The projection is provided on an outer side of the fan guard wherein the outer side of the fan guard is that side which is outermost when the fan guard is mounted on the fan. The projection may be grasped by a user to allow the user to easily mount the fan guard on the fan or remove the fan guard from the fan. This is particularly advantageous when the fan and fan guard are located within a recess (for example, in the housing of an electrical device), making access from the side of the fan and fan guard difficult or impossible. The central projection may have any shape suitable for a user to grasp. For example, the projection may comprise a broad knob, an elongate fin or a curved handhold. The projection may include grip portions.

If the fan guard comprises injection-moulded plastic, preferably the projection is moulded integrally with the body of the fan guard. The projection is preferably provided on the inner support. Alternatively, the projection may be provided on the outer frame or on the ribs.

In one embodiment, the fan guard further comprises at least one locating member on an outer side of the fan guard, the locating member for locating the fan guard relative to the fan.

The outer side of the fan guard is that side which is outermost when the fan guard is mounted on the fan. The or each locating member may comprise clips. If the fan and fan guard are located within a recess (for example, in the housing of an electrical device), or behind another component, the locating members assist in correctly positioning the fan guard. For example, the locating members may comprise clips or flexible arms, which are able to bend inward to permit the fan guard to be installed in the recess or behind the component, but are biased outward to secure the fan guard in place. To remove the fan guard from the fan, the locating members may be pushed inward to permit the fan guard to be removed from the recess or from behind the component.

If the fan guard comprises injection-moulded plastic, preferably the locating member or members are moulded integrally with the body of the fan guard. The locating member or members are preferably provided on the outer frame. Alternatively, the locating member or members may be provided on the inner support or on the ribs.

In one embodiment, the fan guard further comprises at least one clip on an inner side of the fan guard, the at least one clip for securing a filter between the fan and the fan guard when the fan guard is mounted on the fan.

The inner side of the fan guard is that side which is innermost when the fan guard is mounted on the fan. It may be advantageous to use a filter with the fan, to prevent blockages of the fan by foreign objects (usually in the form of dust or other particles of similar size) and so that cleaning is required less frequently. The filter clip or clips secure the filter between the fan and the fan guard. In addition, the filter clip or clips may ensure that the filter sits properly across the fan and does not interfere with or obstruct any moving parts of the fan.

In one embodiment, the or each clip comprises a post portion and a hook portion. The post portion is arranged to extend through the filter, and the hook portion is arranged to hook the filter in position. Alternatively, the or each clip may comprise grippers to grip the edge of the filter and secure the filter in position. If a plurality of filter clips are provided, they each may have a different construction.

Any suitable number of filter clips may be provided. For example, one, two, three, four, five, six or more filter clips may be provided. The particular number of filter clips may depend on the shape of the fan guard, the shape of the fan or the design of the filter. The filter clips may be positioned at any suitable position on the fan guard. If the fan guard comprises injection-moulded plastic, the filter clips may be moulded integrally with the body of the fan guard. The filter clips are preferably provided on the inner support. Alternatively, the filter clips may be provided on the outer frame or on the ribs.

The filter may comprise a sheet of planar material. The sheet may have the same shape and size as the cross section of the fan guard.

According to a second aspect of the invention, there is provided electrical apparatus comprising: an electrically-operated axial-flow fan, the fan including a plurality of holes; a fan guard mounted on the fan, the fan guard including a plurality of fasteners; and a projection projecting outwardly from the fan guard from a central support which, in use, is coincident with a central region of the air flow from the axial-flow fan; wherein each fastener on the fan guard extends into a respective one of the holes on the fan, the fasteners securing the fan guard on the fan by a friction fit between the fasteners and the holes.

The fasteners allow the fan guard to be mounted on and removed from the fan. The friction fit fastening does not require tools, and permits easy installation and removal of the fan guard. Again, the fasteners allow the fan guard to be easily mounted on and removed from the fan, but the term "fan" in this context should be interpreted broadly.

The electrical apparatus may further comprise a housing having a recess, and the fan and the fan guard may fit within the recess.

In one embodiment, the fan guard comprises an outer frame, an inner support and a plurality of ribs extending between the outer frame and the inner support. Such a structure provides adequate support for the fan guard whilst also allowing airflow through the fan guard. If the fan and fan guard are positioned in a recess of a housing of the electrical apparatus, the outer frame may have the same cross sectional shape and size as the recess.

Preferably, the fan guard comprises injection-moulded plastic. The fan, or parts of the fan, may also comprise injection-moulded plastic.

In one embodiment, each fastener on the fan guard comprises a plurality of body portions for extending into the respective hole on the fan, the body portions arranged to be compressed towards each other when the fastener is inserted into the hole, so as to provide the friction fit.

As the projection projects outwardly from the fan guard, the projection allows for grasping by a user. The projection is provided on an outer side of the fan guard wherein the outer side of the fan guard is that side which is outermost when the fan guard is mounted on the fan. The projection may be grasped by a user to allow the user to easily mount the fan guard on the fan or remove the fan guard from the fan. If the fan and fan guard are positioned in a recess of a housing of the electrical apparatus, access from the side of the fan and fan guard may be difficult or impossible. The projection allows a user to access the outer side of the fan guard to install and remove the fan guard from the fan.

In one embodiment, the fan guard further comprises at least one locating member on an outer side of the fan guard, the locating member for locating the fan guard relative to the fan. The outer side of the fan guard is that side which is outermost when the fan guard is mounted on the fan. If the fan and fan guard are positioned in a recess of a housing of the electrical apparatus or behind another component, the locating member or members may assist with locating the fan guard in the recess.

In one embodiment, the fan guard further comprises at least one clip on an inner side of the fan guard, the at least one clip for securing a filter between the fan and the fan guard. The inner side of the fan guard is that side which is innermost when the fan guard is mounted on the fan.

The fan guard is preferably suitably sized and shaped for use with the fan. The fan guard may have the same cross sectional shape and size as the fan. Moreover, the fan guard is preferably suitably sized and shaped for use with an electrical device, the fan being arranged to cool electrical components in the device. It is possible that a number of different fan guards are usable with the fan. Thus, a user may choose the particular fan guard to use with the fan from a supplier which suits the user. The fan may comprise any type of fan which is suitable for cooling electrical equipment.

The fan guard may be used with any electrical device which requires cooling. For example, the electrical device may comprise computer equipment, telecommunications equipment, or many other electrical power systems which require cooling.

Features described in relation to one aspect of the invention may also be applicable to the other aspect of the invention.

BRIEF DESCRIPTION OF THE DRAWINGS

The invention will be further described, by way of example only, with reference to the accompanying drawings, of which.

DETAILED DESCRIPTION

Figure 1:
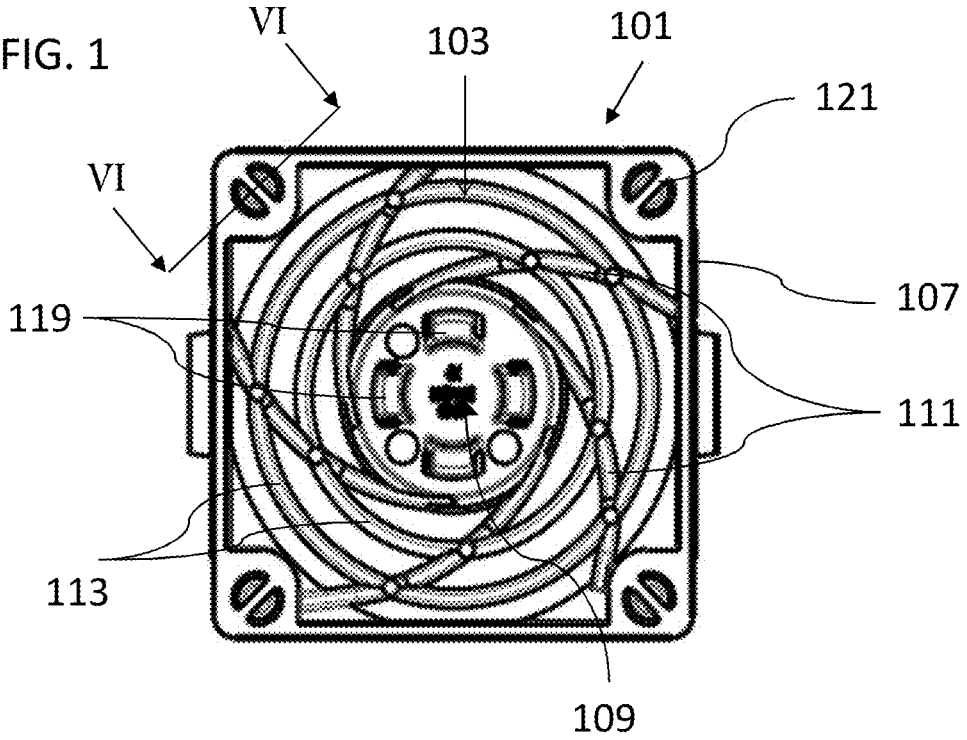
FIG. 1 is a back view of a fan guard according to one embodiment of the invention.
Figure 2:
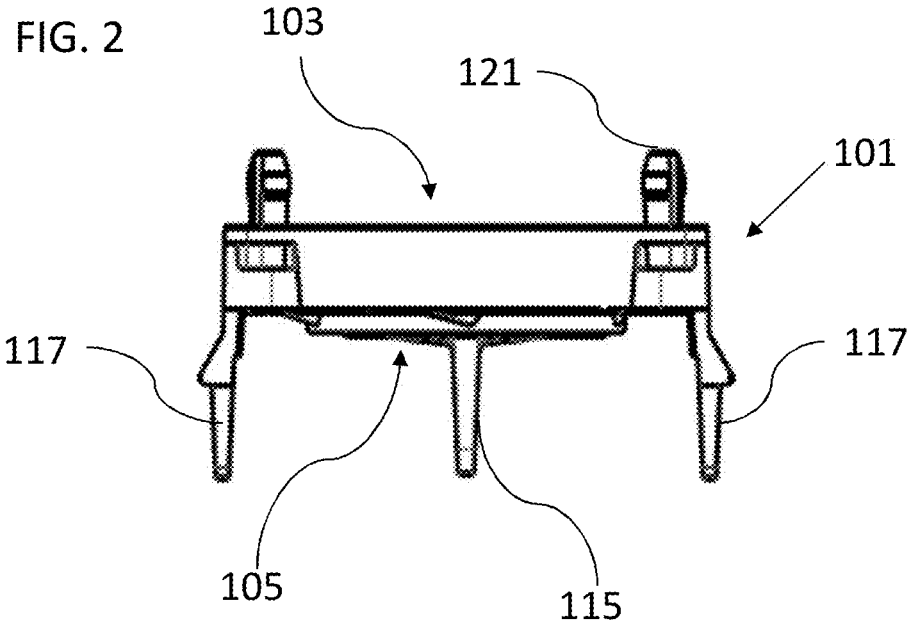
FIG. 2 is an end view of the fan guard of FIG. 1.
Figure 3:
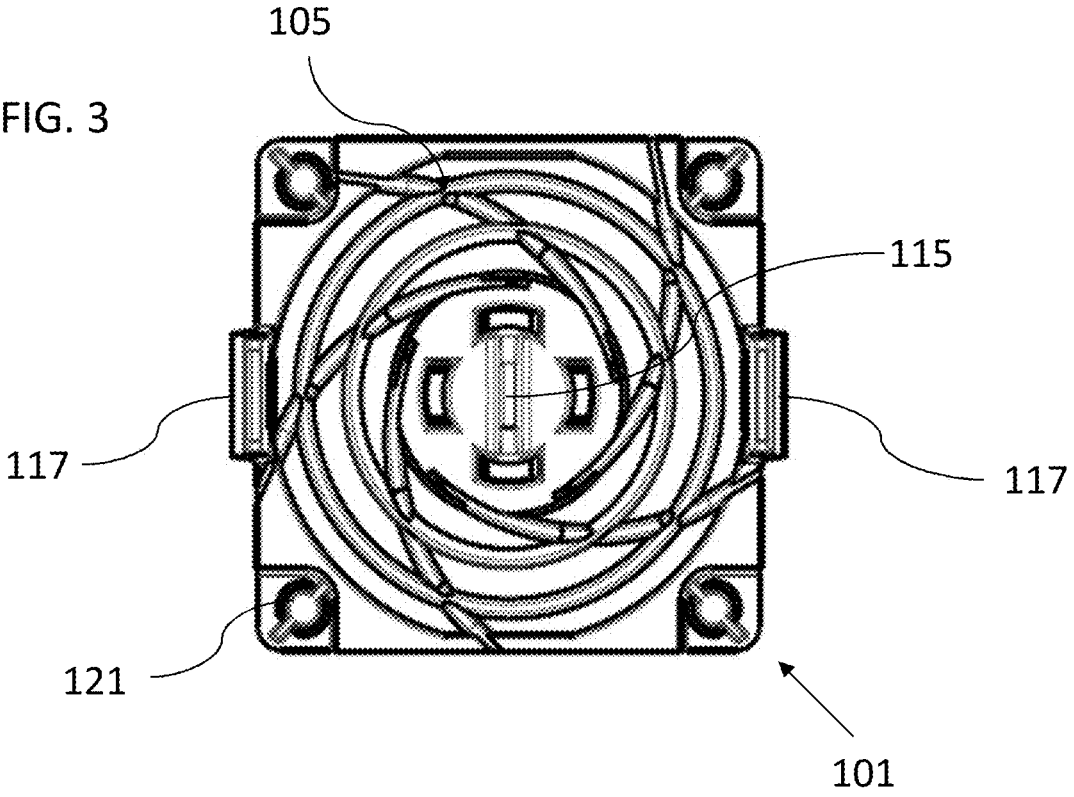
FIG. 3 is a front view of the fan guard of FIG. 1.

FIGS. 1 to 5 show a fan guard according to one embodiment of the invention. With reference to FIGS. 1 to 5, in this embodiment, fan guard 101 comprises a first side 103 and a second side 105. Since the first side 103 will be inward facing when the fan guard is mounted onto a fan (see FIGS. 9 and 10), this will be referred to as the inner side. Since the second side 105 will be outward facing when the fan guard is mounted onto a fan (see FIGS. 9 and 10), this will be referred to as the outer side. The fan guard comprises an outer frame 107, a central support 109 and a plurality of radial ribs 111 joining the outer frame 107 to the central support 109. For further structural support, circular ribs 113 are also provided. When the fan guard is mounted on a fan (to be described further with reference to FIGS. 9 and 10), the ribs 111, 113 prevent fingers or foreign objects being inserted into the moving parts of the fan, but still allow air flow through the fan guard.

The outer side 105 includes a projection in the form of fin 115 and two locating members in the form of arms 117. In this embodiment, the fin 115 projects from the central support 109 and is generally in the centre of the outer side 105. The fin 115 may be grasped by a user to mount the fan guard on the fan and remove the fan guard from the fan (to be described further with reference to FIGS. 9 and 10). The arms 117 are provided on two opposite edges of the outer frame 107. The arms project from the outer side 105 and may be used to locate the fan guard in the correct position (for example, in the recess of a housing) when installed on a fan (to be described further with reference to FIGS. 9 and 10). In this embodiment, the arms 117 are flexible and, as the fan guard is being moved into position, they are able to bend inward, for example to allow the fan guard to be inserted into a recess or behind another component. At a certain point, the arms 117 move back to their original position, securing the fan guard in the recess or behind the other component, and locking the fan guard into place. When the fan guard is to be removed, the arms 117 may be pushed inward to allow the fan guard to be removed, preferably by grasping the fin 115.

The inner side 103 includes four filter clips 119. In this embodiment, the filter clips project from the central support 109. When the fan guard 101 is installed onto a fan, the filter clips 119 extend towards the fan, and can be used to secure a filter (not shown in FIGS. 1 to 5) between the fan and the fan guard 101. This will be described further with reference to FIG. 8. In this embodiment, four filter clips are provided, but any number of filter clips may be provided. Moreover, in this embodiment, the filter clips 119 are provided substantially in the centre of the inner side, but the filter clips may be located at any suitable position or positions on the fan guard's inner side.

The fan guard further comprises fasteners 121 for mounting the fan guard onto a fan. In this embodiment, there are four fasteners 121, but any number of fasteners may be provided. In this embodiment, one fastener is located at each corner of the fan guard, but the fasteners may be positioned at any suitable points on the fan guard. Fasteners 121 are used to mount the fan guard 101 onto a fan, without the need for screws, rivets or any other fixing means that require a tool. This will be described further with reference to FIGS. 6 and 7.

Figure 6:
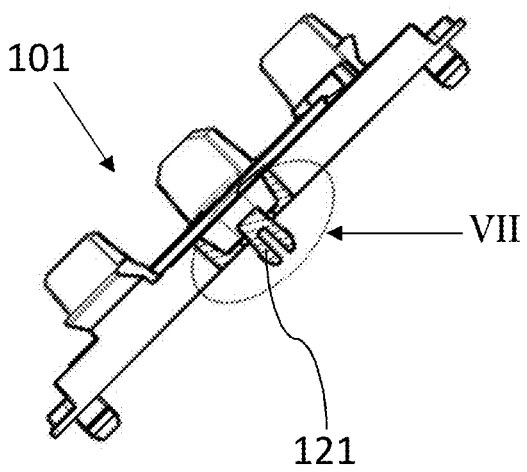
FIG. 6 is a section view along line VI-VI of FIG. 1.
Figure 7:
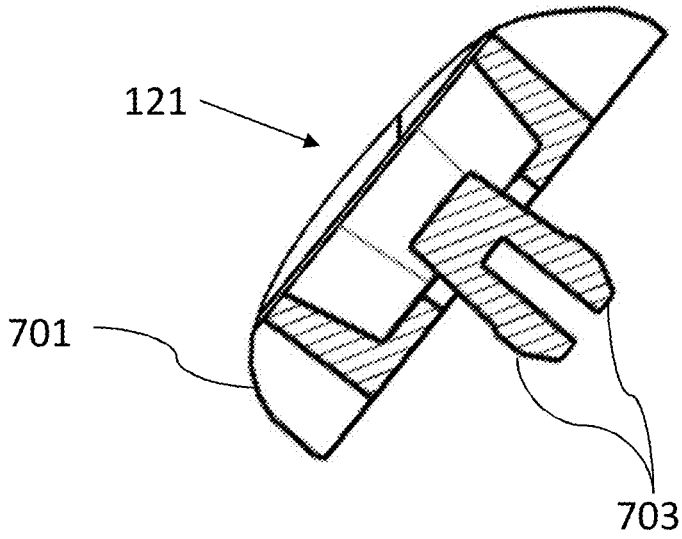
FIG. 7 is an enlarged view of area VII of FIG. 6.

FIG. 6 is a section view along line VI-VI of FIG. 1 and FIG. 7 is an enlarged view of area VII of FIG. 6. FIGS. 6 and 7 show a fastener 121 in more detail. The fastener comprises a head portion 701 on the outer side of the fan guard and two body portions 703 on the inner side of the fan guard. The two body portions protrude from the inner side of the fan guard and are arranged to extend into a hole in a fan when the fan guard is mounted on the fan. The two body portions have curved outer edges (that is, they each have a substantially semi-circular cross section) so as to fit within a hole of circular cross section. The hole is sized such that, when the fastener 121 is pushed into the hole, the two body portions 703 are pressed towards each other. This secures the fan guard onto the fan by a friction fit. When the fan guard is removed from the fan, the body portions open up.

In this embodiment, each fastener 121 comprises two body portions. However, only one body portion may be provided. In that case, the body portion should be appropriately shaped and sized to provide a friction fit between the body portion and the hole when the fan guard is mounted on the fan. Alternatively, more than two body portions may be provided, the body portions compressing together to provide the friction fit. The body portion or portions and the hole should be shaped and sized to cooperate with each other and to provide a good friction fit. This secures the fan guard onto the fan, but also allows a user to remove the fan guard from the fan easily.

Preferably, as illustrated in FIG. 6, each of the two body portions 703 comprises a semi-circular shaft having a bulbous head. The two body portions 703 are arranged on the head portion 701 spaced apart from each other by a channel and are positioned such that the curved edges of the shaft form the outer edges of the fastener 121. As described above, the curved outer edges of the body portions 703 allow the fastener 121 to be pushed into a hole with substantially circular cross section. By arranging the two body portions 703 to be spaced slightly apart, the body portions 703 are able to be squeezed together, thereby allowing the fastener 121 to be pushed into a hole with a smaller cross-sectional area than the cross-sectional area of the fastener 121; provided that the cross-sectional area of the hole is equal to or greater that the cross-sectional area of the bulbous heads of the two body portions 703 when squeezed together. Advantageously, the aforementioned arrangement allows for the fastener 121 to be used to frictionally engage with holes having a range of sizes and dimensions.

Figure 4:
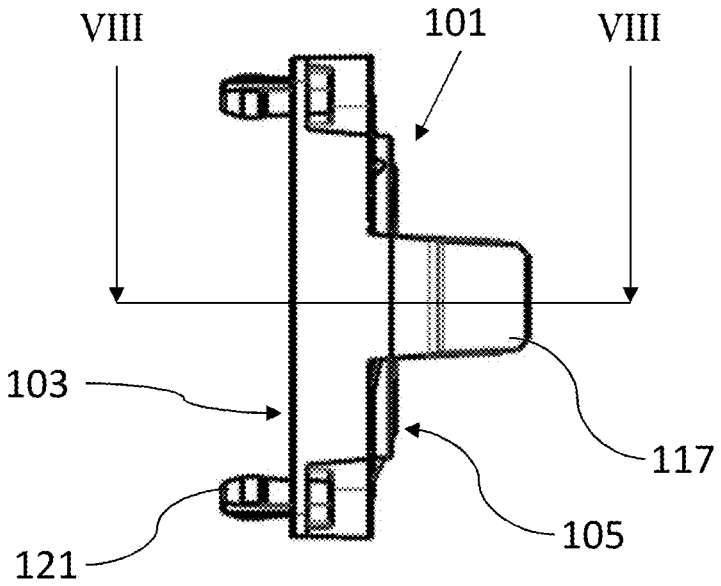
FIG. 4 is a side view of the fan guard of FIG. 1.
Figure 5:
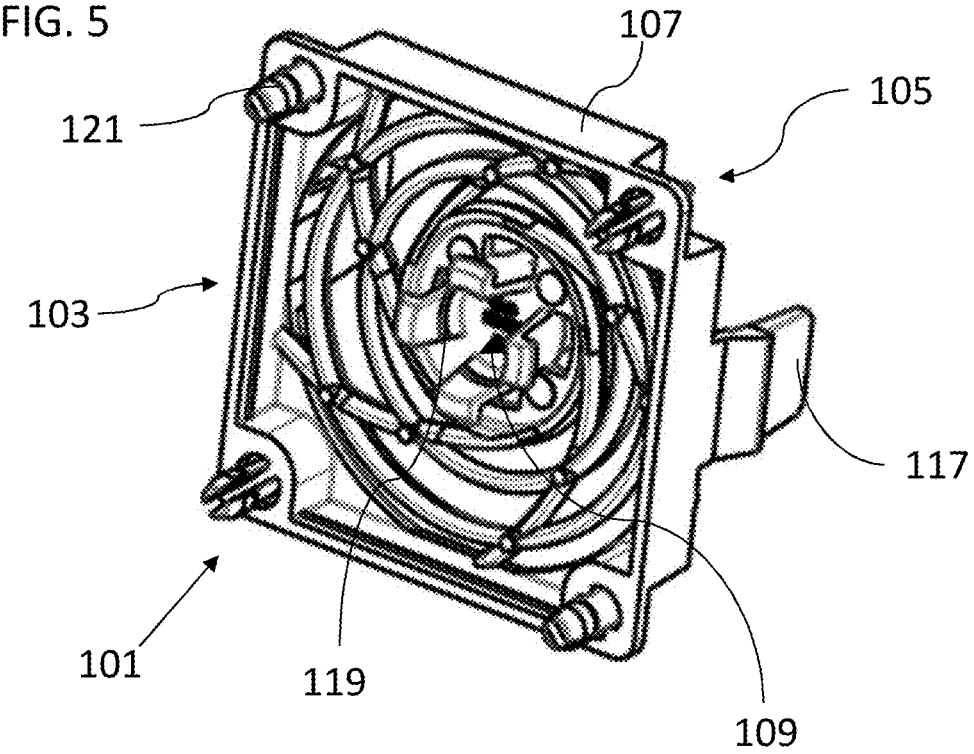
FIG. 5 is a perspective view of the fan guard of FIG. 1.
Figure 8:
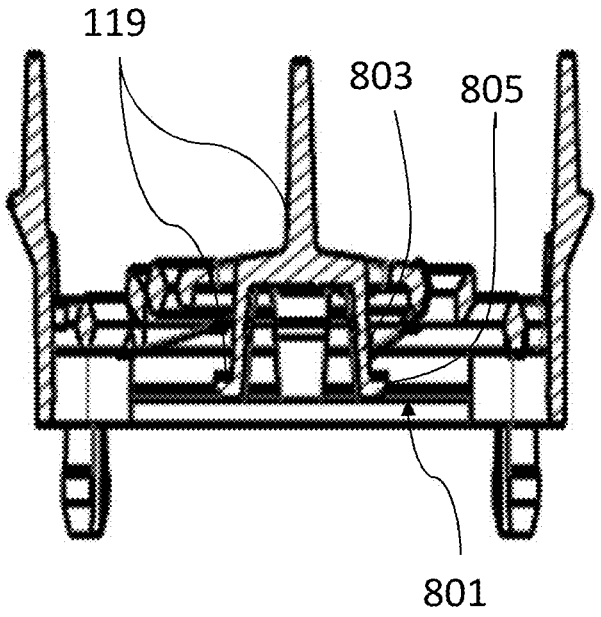
FIG. 8 is a section view along line VIII-VIII of FIG. 4.

FIG. 8 is a section view along line VIII-VIII of FIG. 4. FIG. 8 shows the filter clips 119 in more detail. The filter clips 119 are provided to secure a filter 801 between the fan and the fan guard when the fan guard is mounted on the fan. In this embodiment, each filter clip 119 comprises a post portion 803 and a hook portion 805. The filter clips 119 protrude from the inner side of the fan guard. The post portions 803 and the hook portions 805 are arranged to extend through the filter 801 from the fan guard side of the filter to the fan side of the filter. The hook portions 805 are positioned on the fan side of the filter 805 to hook the filter 801 in place.

The filter clips secure the filter 801 between the fan and the fan guard when the fan guard is mounted on the fan. The filter clips also ensure that the filter sits squarely across the fan and the filter material does not interfere with or obstruct the fan blades.

In this embodiment, each filter clip 119 comprises a post portion 803 for extending through the filter and a hook portion 805 for hooking the filter in place. However, other structures are possible. For example, each filter clip may comprise grippers for gripping an edge of the filter.

Figure 9:
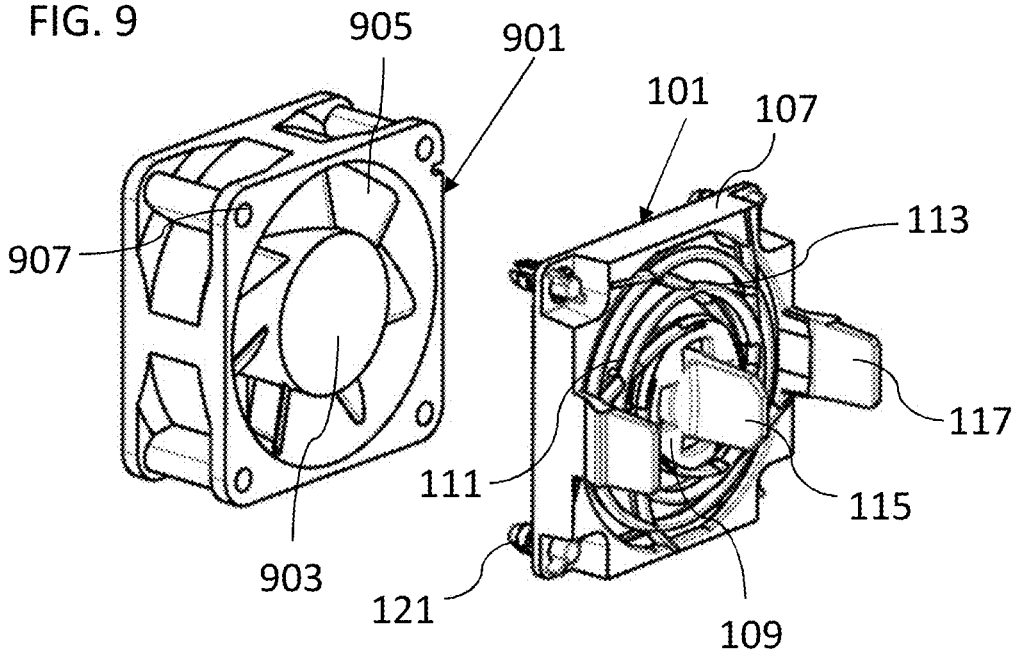
FIG. 9 shows a fan guard according to one embodiment of the invention ready to be mounted on a fan.
Figure 10:
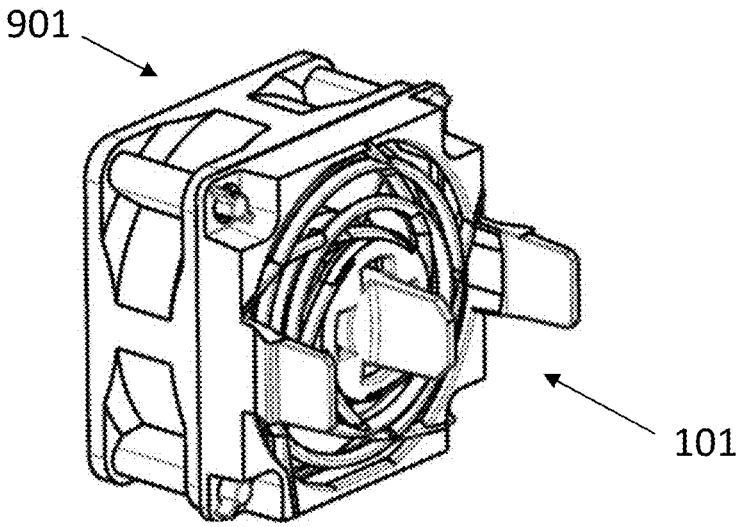
FIG. 10 shows the fan guard of FIG. 9 mounted on a fan.

FIGS. 9 and 10 show a fan guard 101 in cooperation with a fan 901. In FIG. 9, the fan guard 101 is not yet mounted on the fan 901. In FIG. 10, the fan guard 101 is mounted on the fan 901. The fan guard 101 in FIGS. 9 and 10 is as already described in FIGS. 1 to 8. The fan 901 is an electrically-operated axial fan, including a central axis 903, rotating blades 905 and four holes 907, one at each corner of the fan 901. Fan 901 is shown schematically in FIGS. 9 and 10.

In order to mount the fan guard 101 on the fan 901, first if a filter is required, this should be secured using the filter clips 119 (not shown in FIGS. 9 and 10). Then, the user may grasp the fin 115 and direct the fan guard 101 toward the fan 901, aligning the outer frame 107 of the fan guard with the fan. The arms may be used to correctly position the fan by bending inward as the fan guard is positioned, for example in a recess or behind another component. When the fan guard 101 is properly aligned with the fan 901, each fastener 121 on the fan guard 101 aligns with a respective hole 907 on the fan 901. When the fasteners 121 are pushed into the holes 907, the fan guard 101 is secured to the fan 901 by a friction fit. The central support 109 aligns generally with the central axis 903 and the ribs 111, 113 prevent fingers or foreign objects accessing the fan blades 905.

In this embodiment, the fan guard has a generally square cross section when viewed from the front (FIG. 3) or back (FIG. 1). However, the fan guard and fan may have any suitable size and shape. In the described embodiment, the fan guard can be mounted on the fan by a friction fit between the fasteners on the fan guard and the holes in the fan. No tools are required to mount the fan guard on the fan or to remove the fan guard from the fan. Therefore, installation and removal are quick and straightforward. In addition, this means that the user can choose any suitable fan guard for use with the fan and easily mount the chosen fan guard on the fan.

The invention claimed is:

1. A fan guard for mounting on an electrically-operated axial-flow fan, the fan guard comprising:

a plurality of fasteners for extending into a plurality of respective holes on the fan, the fasteners being arranged to secure the fan guard on the fan by a friction fit between the fasteners and the holes;

a projection projecting outwardly from a side of the fan guard opposite the axial-flow fan when the fan guard is mounted on the fan, the projection projecting outwardly from a central support which, in use, is coincident with a central region of the air flow from the axial-flow fan; and two resilient locating members located on opposite outer sides of the fan guard, each resilient locating member projecting substantially axially outward from the side of the fan guard opposite the axial-flow fan when the fan guard is mounted on the fan, wherein said each resilient locating member comprises a surface engaging portion angled away from the projection.

2. A fan guard according to claim 1, wherein the fan guard comprises an outer frame, an inner support and a plurality of ribs extending between the outer frame and the inner support.

3. A fan guard according to claim 1, wherein the fan guard comprises injection-moulded plastic.

4. A fan guard according to claim 1, wherein each fastener comprises a plurality of body portions for extending into the respective hole on the fan, the body portions arranged to be compressed towards each other when the fastener is inserted into the hole, so as to provide the friction fit.

5. A fan guard according to claim 4, wherein the plurality of body portions each comprise a shaft with a bulbous head.

6. A fan guard according to claim 1, further comprising at least one clip on an inner side of the fan guard, the at least one clip for securing a filter between the fan and the fan guard when the fan guard is mounted on the fan.

7. An electrical apparatus comprising:

an electrically-operated axial-flow fan, the fan including a plurality of holes;

a fan guard mounted on the fan, the fan guard including a plurality of fasteners;

a projection projecting outwardly from a side of the fan guard opposite the axial-flow fan, the projection projecting outwardly from a central support which, in use, is coincident with a central region of the air flow from the axial-flow fan; and two resilient locating members located on opposite outer sides of the fan guard, each resilient locating member projecting substantially axially outward from the side of the fan guard opposite the axial-flow fan when the fan guard is mounted on the fan, wherein said each resilient locating member comprises a surface engaging portion angled away from the projection;

wherein each fastener on the fan guard extends into a respective one of the holes on the fan, the fasteners securing the fan guard on the fan by a friction fit between the fasteners and the holes.

8. The electrical apparatus according to claim 7, further comprising a housing having a recess, wherein the fan and the fan guard fit within the recess.

9. The electrical apparatus according to claim 7, wherein the fan guard comprises an outer frame, an inner support and a plurality of ribs extending between the outer frame and the inner support.

10. The electrical apparatus according to claim 7, wherein the fan guard comprises injection-moulded plastic.

11. The electrical apparatus according to claim 7, wherein each fastener on the fan guard comprises a plurality of body portions for extending into the respective hole on the fan, the body portions arranged to be compressed towards each other when the fastener is inserted into the hole, so as to provide the friction fit.

12. The electrical apparatus according to claim 11, wherein the plurality of body portions each comprise a shaft with a bulbous head.

13. The electrical apparatus according to claim 7, wherein the fan guard further comprises at least one clip on an inner side of the fan guard, the at least one clip for securing a filter between the fan and the fan guard.

* * * * *